US010408161B2

(12) United States Patent
Fukuyoshi

(10) Patent No.: US 10,408,161 B2
(45) Date of Patent: Sep. 10, 2019

(54) ENGINE

(71) Applicant: YANMAR CO., LTD., Osaka-shi, Osaka (JP)

(72) Inventor: Shinya Fukuyoshi, Osaka (JP)

(73) Assignee: YANMAR CO., LTD., Osaka (JP)

( * ) Notice: Subject to any disclaimer, the term of this patent is extended or adjusted under 35 U.S.C. 154(b) by 9 days.

(21) Appl. No.: 15/539,365

(22) PCT Filed: Dec. 3, 2015

(86) PCT No.: PCT/JP2015/083957
§ 371 (c)(1),
(2) Date: Jun. 23, 2017

(87) PCT Pub. No.: WO2016/104091
PCT Pub. Date: Jun. 30, 2016

(65) Prior Publication Data

US 2017/0356385 A1 Dec. 14, 2017

(30) Foreign Application Priority Data

Dec. 26, 2014 (JP) ..... 2014-265623

(51) Int. Cl.
*F01P 3/02* (2006.01)
*F02F 1/30* (2006.01)
(Continued)

(52) U.S. Cl.
CPC ..... *F02F 1/305* (2013.01); *F01P 3/02* (2013.01); *F02F 1/4242* (2013.01); *F02N 9/04* (2013.01); *F02B 3/12* (2013.01)

(58) Field of Classification Search
CPC . F02F 1/305; F02F 1/4242; F01P 3/02; F02B 3/12; F02N 9/04
(Continued)

(56) References Cited

U.S. PATENT DOCUMENTS 4,671,226 A * 6/1987 van Rinsum ..... F01L 13/00 123/179.31
4,878,550 A * 11/1989 Chuang ..... E21B 4/14 175/296
(Continued)

FOREIGN PATENT DOCUMENTS

CN 201620963 U 11/2010
GB 28226 A 12/1912
(Continued)

OTHER PUBLICATIONS

Japan Patent Office, International Search Report in International Application No. PCT/JP2015/083957, dated Jan. 12, 2016, 2 pages.
(Continued)

*Primary Examiner* — Joseph J Dallo
*Assistant Examiner* — Yi-Kai Wang
(74) *Attorney, Agent, or Firm* — Norton Rose Fulbright US LLP

(57) ABSTRACT

Provided is an engine with a starter valve arranged in a compact space and with a cylinder head having a cooling water passage and a starter valve feeding compressed air to a combustion chamber. The starter valve is arranged parallel in the axial direction to a cylinder while fitted into a sleeve, and a portion of the cooling water passage is formed by the outer surface of the sleeve fitted into a starter valve insertion hole formed in the cylinder head. A starting air passage orthogonal to the axial direction of the starter valve insertion hole is formed in the cylinder head, and a portion of the wall surface of the starting air passage is formed by the end surface on one side of the sleeve.

20 Claims, 3 Drawing Sheets

(51) Int. Cl.
*F02N 9/04* (2006.01)
*F02F 1/42* (2006.01)
*F02B 3/12* (2006.01)

(58) Field of Classification Search
USPC ..... 123/41.82 A
See application file for complete search history.

(56) References Cited

U.S. PATENT DOCUMENTS

| | | | | |
|---|---|---|---|---|
| 2002/0189565 | A1* | 12/2002 | Okuma | B62K 11/14 123/179.18 |
| 2008/0267795 | A1* | 10/2008 | Singer | F01L 1/46 417/399 |
| 2009/0217913 | A1* | 9/2009 | Toyoda | F02F 1/242 123/470 |
| 2015/0069662 | A1* | 3/2015 | Mai | B29C 45/43 264/328.1 |
| 2016/0003176 | A1* | 1/2016 | Marscheider | F02D 41/0027 123/445 |
| 2016/0009004 | A1* | 1/2016 | Penkkimaki | B29C 33/10 251/318 |

FOREIGN PATENT DOCUMENTS

| | | | |
|---|---|---|---|
| GB | 28226 | A | 12/1913 |
| GB | 15107 | A | 10/1915 |
| GB | 15107 | A | 8/1916 |
| GB | 174609 | A | 5/1957 |
| GB | 883710 | A | 12/1961 |
| GB | 2018903 | A | 10/1979 |
| JP | S29-8021 | Y1 | 7/1954 |
| JP | S42-6811 | Y1 | 3/1967 |
| JP | S52-124302 | U | 9/1977 |
| JP | H11-141396 | | 5/1999 |
| JP | 2005-090297 | A | 4/2005 |
| JP | 2005-240813 | A | 9/2005 |
| JP | 2009-203913 | A | 9/2009 |
| WO | WO 2011/091572 | A1 | 8/2011 |

OTHER PUBLICATIONS

Supplementary European Search Report dated dated Nov. 24, 2017, received in European Application No. 15872660.4.

* cited by examiner

ENGINE

CROSS-REFERENCE TO RELATED APPLICATIONS

This is a national phase application based on the PCT international Patent Application No. PCT/JP2015/083957filed Dec. 3, 2015, claiming priority to Japanese Patent Application No. 2014-265623filed Dec 26, 2014, the entire contents of both of which are incorporated herein by reference.

TECHNICAL FIELD

The present invention relates to a technique of an engine.

BACKGROUND ART

Compressed-air starting is one known mechanism for starting engines. The compressed-air starting includes feeding compressed air into a cylinder with a starter valve, pressing down a piston with the compressed air thus fed, and increasing an engine speed to an engine speed high enough to start the engine.

Conventionally, the starter valve has been oriented toward a combustion chamber in a cylinder head and is arranged in parallel with or orthogonal to an axial direction of the cylinder. Unfortunately, the configuration in which the starter valve is arranged orthogonal to the axial direction of the cylinder involves an extra space (dead volume) formed in the combustion chamber (for example, a starting air discharge path in Patent Literature 1).

The configuration in which the starter valve is arranged in parallel with the axial direction of the cylinder requires a large thickness to separate the starter valve and a cooling water passage from each other in the cylinder head. Thus, the starter valve requires a large space to be disposed in the cylinder head. Reducing a space for providing the starter valve has been an important technical task for downsizing of the engine involving downsizing of the cylinder head.

CITATION LIST

Patent Literature

PTL 1: Japanese Unexamined Patent Application Publication No. 2005-240813

SUMMARY OF INVENTION

Technical Problem

An object of the present invention is to provide an engine in which a starter valve can be disposed in a space saving manner.

Solution to Problem

A solution to achieve the object described above is described below.

An engine according to the present invention includes a cylinder head in which a starter valve with which compressed air is fed to a combustion chamber is provided and a cooling water passage is formed. The starter valve is arranged in parallel with an axial direction of a cylinder while being fit in a sleeve. An outer circumferential surface of the sleeve forms a part of a wall surface of the cooling water passage. The sleeve is fit in a starter valve insertion hole formed in the cylinder head. An air passage is formed in the cylinder head to be orthogonal to an axial direction of the starter valve insertion hole. The air passage communicates with a distal end surface of the sleeve in an inserted direction. A step portion that engages with a step portion of the starter valve insertion hole is formed on an outer circumference of the sleeve.

In the engine according to the present invention, compressed air sent in through the air passage may be sent into the combustion chamber through a side surface of the sleeve and supply hole formed in the starter valve.

Advantageous Effects of Invention

In the engine according to the present invention, the starter valve can be disposed in a space saving manner.

DESCRIPTION OF EMBODIMENTS

A configuration of an engine 100 is described with reference to FIG. 1.

Figure 1:
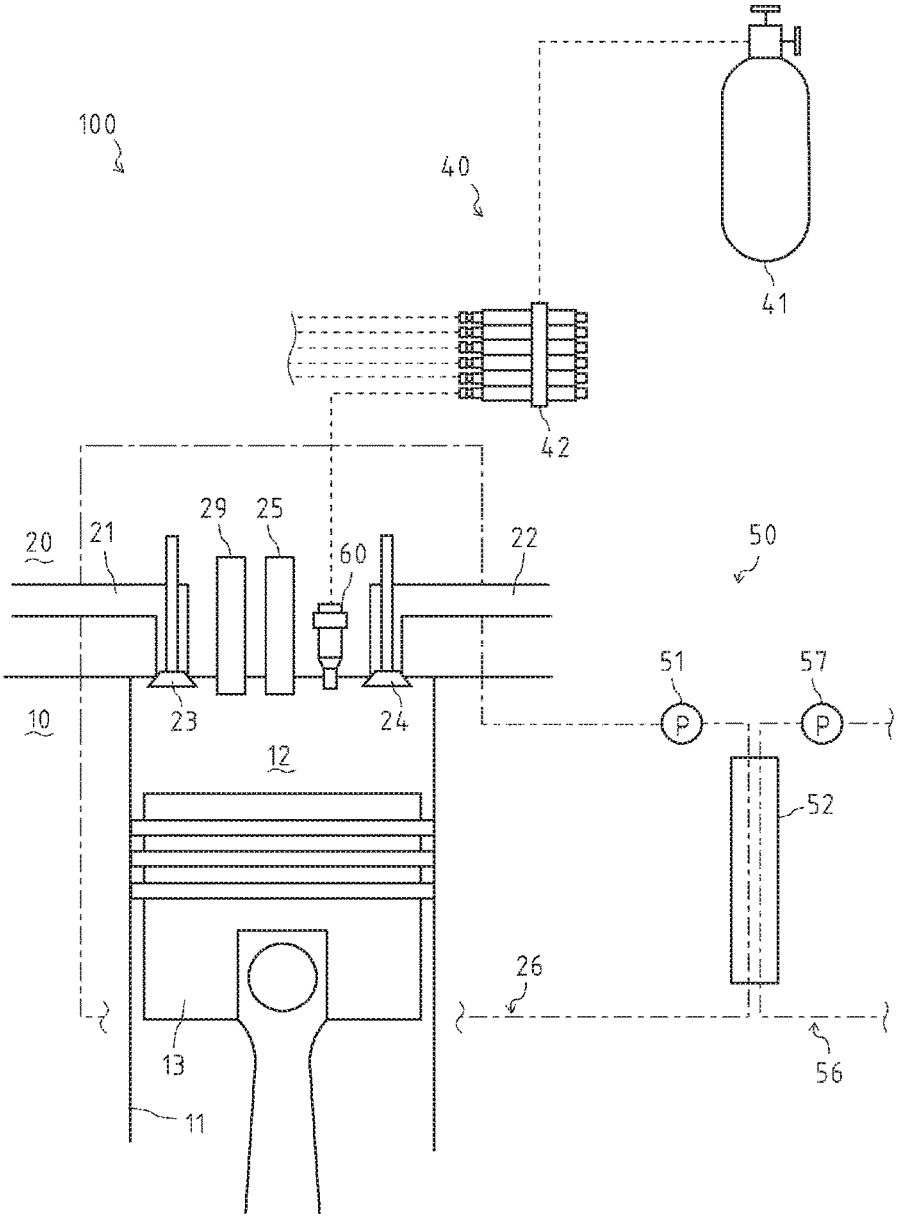
FIG. 1 is a schematic view illustrating a configuration of an engine.

FIG. 1 schematically illustrates one of cylinders in the configuration of the engine 100. A dotted line in FIG. 1 represents a route of air. A dotted dashed line in FIG. 1 indicates a route of cooling water (fresh water or sea water).

The engine 100 is an embodiment of an engine according to the present invention. The engine 100 according to the present embodiment is a straight-six dual-fuel engine installed in large vessels. An operation mode of the dual-fuel engine can be switched as appropriate between a gas operation mode in which the engine operates with combustion gas burned, and a diesel operation mode in which the engine operates with fuel oil burned.

The engine 100 according to the present embodiment is not limited to the straight-six dual-fuel engine installed in large vessels. For example, the engine 100 may be an eight-cylinder engine or a diesel engine used for a land generator.

The engine 100 includes a cylinder block 10 and a cylinder head 20. The engine 100 further includes a compressed air starting device 40 and a cooling device 50.

In the cylinder block 10, a cylinder 11 and a combustion chamber 12 are formed. A piston 13 is slidably accommodated in the cylinder 11. The combustion chamber 12 is defined by the cylinder 11, a top portion of the piston 13, and the cylinder head 20.

The cylinder head 20 is provided with an intake port 21, a discharge port 22, an intake valve 23, a discharge valve 24, a fuel oil injection device 25, a gas ignition device 29, and a starter valve 60.

The intake port 21 is an inlet through which air enters the combustion chamber 12. The discharge port 22 is an outlet through which the air is discharged from the combustion chamber 12. The intake valve 23 is a valve for controlling opening/closing of the intake port 21. The discharge valve 24 is a valve for controlling opening/closing of the discharge port 22.

The intake port 21 is supplied with gas from an unillustrated gas supply device, and has an air-fuel ratio adjusted with an unillustrated throttle. Air taken in is mixed with the gas, and the resultant mixture is ignited by the gas ignition device 29.

The fuel oil injection device 25 is a valve with which combustion oil is injected into the combustion chamber 12 while the engine is in the diesel operation mode. The gas ignition device 29 is a device that injects fuel gas such as natural gas into the combustion chamber 12 while the engine is in the gas operation mode.

The starter valve 60 is a valve with which compressed air, sent from the compressed air starting device 40, is fed to the combustion chamber 12. The starter valve 60 is arranged in parallel with the axial direction of the cylinder 11, and is oriented toward the combustion chamber 12, in the cylinder head 20.

The compressed air starting device 40 starts the engine 100 with the compressed air. More specifically, the compressed air starting device 40 sends the compressed air to the combustion chamber 12 so that the piston 13 is pressed down with expansive power of the compressed air to rotate a crank shaft, whereby the engine 100 starts.

The compressed air starting device 40 includes the starter valve 60, an air container 41, and a distributing valve 42.

The air container 41 stores starting air under a predetermined pressure. The air container 41 includes: a valve box to which attachments are attached; and an air container main body. The attachments thus attached include an air container starter valve, air container charging valve, a drain valve, a safety valve, a pressure meter, and a lead plug (not illustrated).

The distributing valve 42 operates in such a manner that the compressed air is blown into the cylinder 11, upon being matched with a piston position of the cylinder 11. The distributing valve 42 includes a valve, a valve body, and a valve cover, and is driven by a cam shaft.

The cooling device 50 is a device that prevents overheating by the combustion, with cooling water flowing in a cooling water passage 26 formed around the combustion chamber 12, that is, in the cylinder block 10 and the cylinder head 20. The cooling device 50 includes a cooling water pump 51, a heat exchanger 52, the cooling water passage 26, a sea water passage 56, and a sea water pump 57.

The cooling water (fresh water in the present embodiment) circulates in the cooling water passage 26. The cooling water pump 51 sends water in a predetermined direction in the cooling water passage 26. The heat exchanger 52 is in charge of heat exchange between the cooling water in the cooling water passage 26 and the sea water in the sea water passage 56.

The sea water exchanges heat with the cooling water while flowing in the sea water passage 56. The sea water pump 57 sends water in a predetermined direction in the sea water passage 56.

A configuration of the starter valve 60 is described with reference to FIG. 2.

Figure 2:
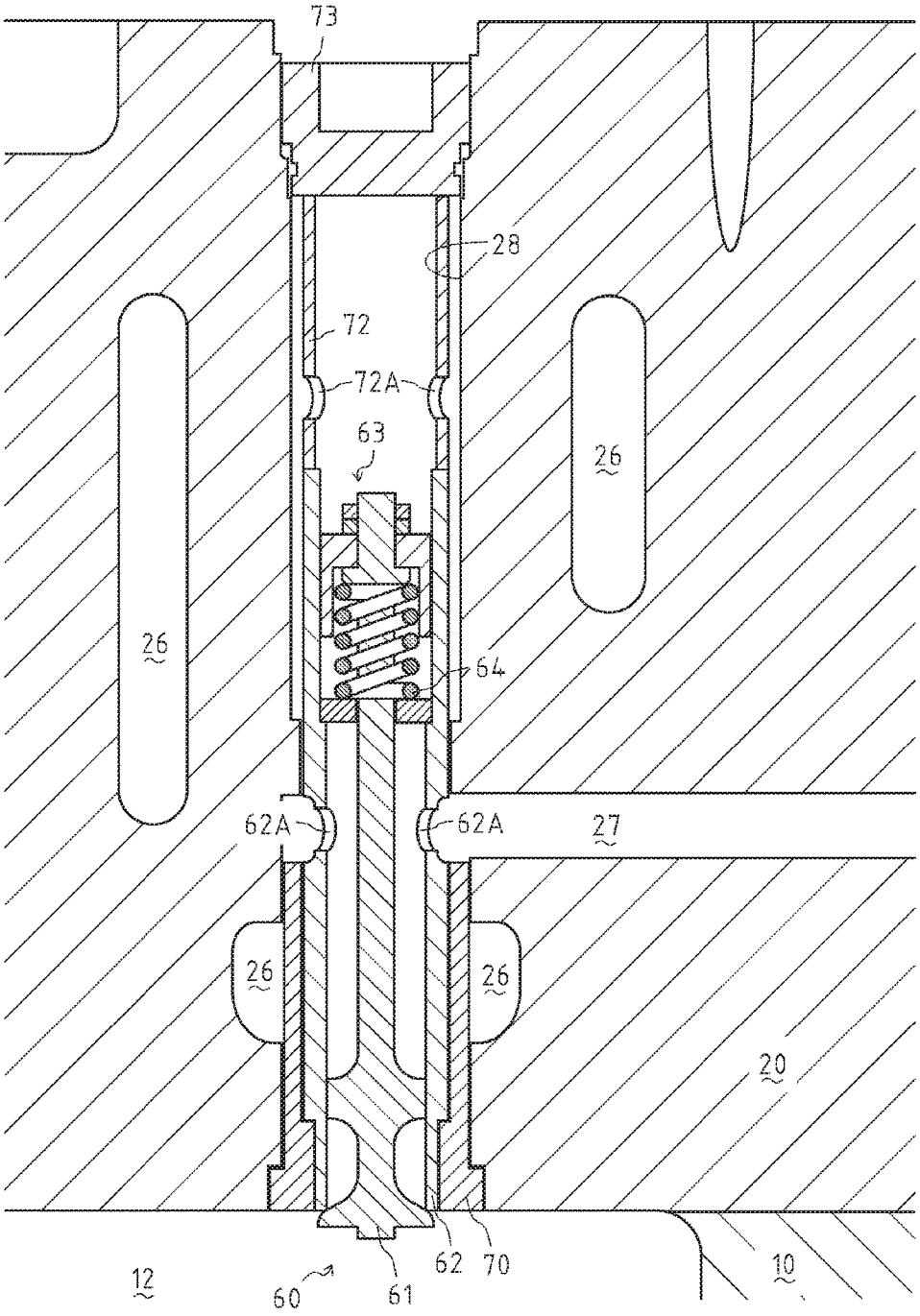
FIG. 2 is a cross-sectional view illustrating a configuration of a starter valve.

FIG. 2 is a schematic cross-sectional view illustrating the configuration of the starter valve 60.

In the cylinder head 20, the cooling water passage 26 described above, a starting air passage 27 as an air passage, a starter valve insertion hole 28, and a control air passage (not illustrated) are formed.

The starter valve insertion hole 28 is formed to be in parallel with the axial direction of the cylinder 11. The starter valve 60 fit in a sleeve 70, a supporting member 72, and a lid member 73 are disposed in the starter valve insertion hole 28.

The starting air passage 27 is formed to be orthogonal with the starter valve insertion hole 28. The starting air passage 27 has one side in communication with an intermediate portion of the starter valve insertion hole 28 that is an upper portion of the sleeve 70. The control air passage is formed to be in communication with a portion above a pilot valve 63 that is an intermediate portion of the supporting member 72.

As described above, the starter valve 60 is a valve with which the compressed air, sent from the compressed air starting device 40, is fed to the combustion chamber 12. The starter valve 60 is fit in the sleeve 70 and is arranged in parallel with the axis of the cylinder 11, in the cylinder head 20. The starter valve 60 includes a valve body 61, a casing 62, a pilot valve 63, and a return spring 64.

The casing 62 has a cylindrical shape, and has an intermediate portion on which a supply hole 62A is formed. The casing 62 incorporates the valve body 61, the return spring 64, and the pilot valve 63. The valve body 61 is biased upward by the return spring 64, and is contained in the casing 62 in such a manner as to be slidable in the axial direction.

The pilot valve 63 is a valve with which the valve body 61 is pressed downward by pressure of control air sent into the supporting member 72. The return spring 64 biases the valve body 61 upward with respect to the casing 62.

In the starter valve 60 with such a configuration, the starting air (compressed air), sent from the starting air passage 27, passes through the supply hole 62A of the casing 62 to be sent into the casing 62. Then, the pilot valve 63 presses the valve body 61 downward due to the pressure of the control air, and the compressed air in the casing 62 is sent into the combustion chamber 12.

The sleeve 70 in which the starter valve 60 is fit has a substantially cylindrical shape. More specifically, the sleeve 70 is inserted and fit in the starter valve insertion hole 28 with no gap in between.

The supporting member 72 has a substantially cylindrical shape, and is disposed between the starter valve 60 and the lid member 73 in the starter valve insertion hole 28. A supply hole 72A through which the control air, supplied through the control air passage, is sent into the supporting member 72, is formed on the supporting member 72.

The lid member 73 has a substantially column shape, and is disposed above the supporting member 72 in the starter valve insertion hole 28. More specifically, the lid member 73 is inserted and fit in the starter valve insertion hole 28 with no gap in between.

A configuration of the sleeve 70 is described with reference to FIG. 3.

Figure 3:
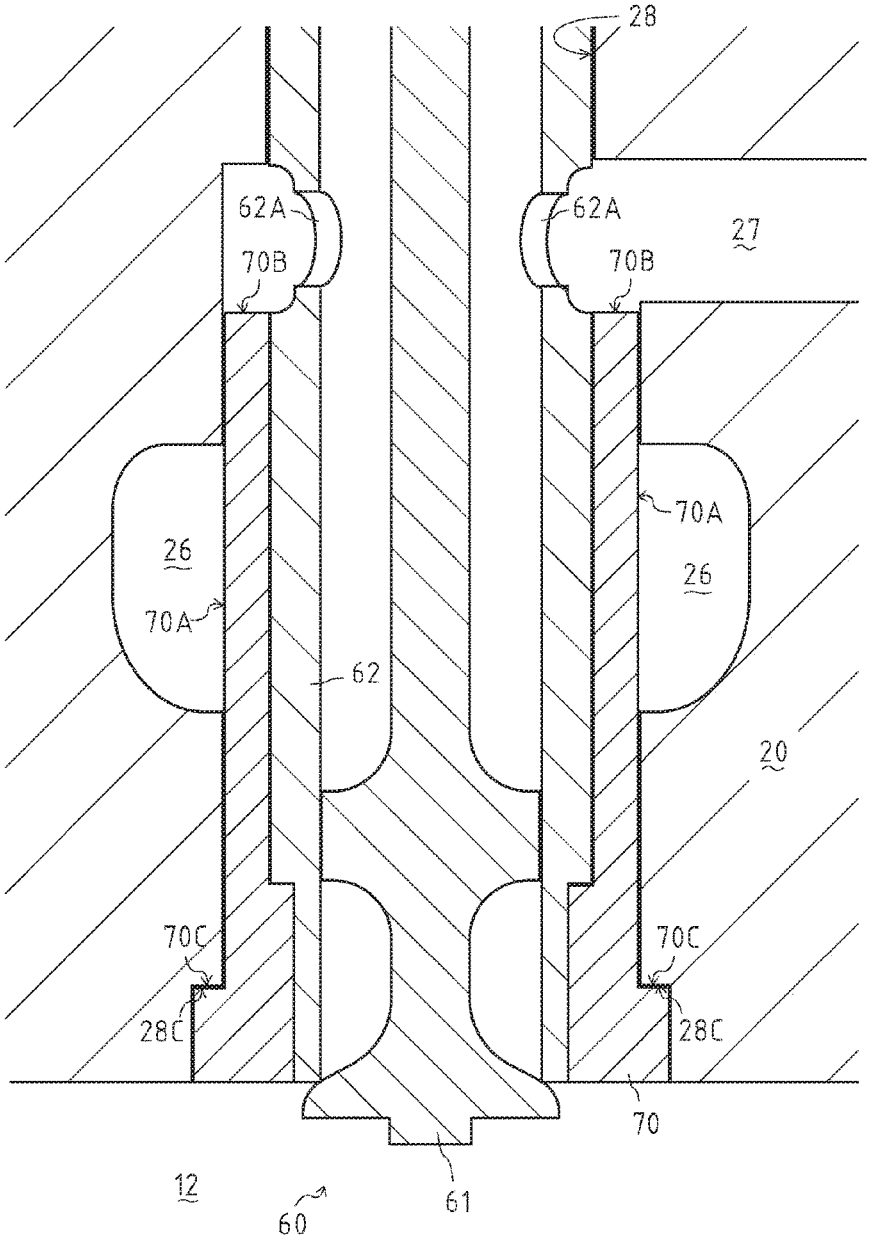
FIG. 3 is a cross-sectional view illustrating a configuration of a sleeve.

FIG. 3 is a schematic cross-sectional view illustrating the configuration of the sleeve 70.

As described above, the sleeve 70 has the substantially cylindrical shape, and includes an outer circumferential surface 70A and a distal end surface 70B. A step portion 70C is formed on the outer circumferential surface 70A of the sleeve 70.

In a state where the starter valve 60 is fit in the sleeve 70 and the sleeve 70 in which the starter valve 60 is fit is fit in the starter valve insertion hole 28, the outer circumferential surface 70A of the sleeve 70 forms a part of the wall surface of the cooling water passage 26 formed around the sleeve 70.

In other words, the part of the wall surface of the cooling water passage 26 formed around the sleeve 70 is formed of the outer circumferential surface 70A of the sleeve 70.

In the state where the starter valve 60 is fit in the sleeve 70 and the sleeve 70 in which the starter valve 60 is fit is fit in the starter valve insertion hole 28, the distal end surface 70B of the sleeve 70 forms a part of the wall surface of the starting air passage 27. In other words, the part of the wall surface of the starting air passage 27 is formed of the distal end surface 70B of the sleeve 70.

In the state where the starter valve 60 is fit in the sleeve 70 and the sleeve 70 in which the starter valve 60 is fit is fit in the starter valve insertion hole 28, the step portion 70C of the sleeve 70 is engaged with a step portion 28C formed on the starter valve insertion hole 28.

Next, an effect of the engine 100 is described.

The engine 100 has an effect that the starter valve 60 can be disposed in a space saving manner.

Conventionally, the starter valve has been arranged in parallel with or orthogonal to the axial direction of the cylinder. Unfortunately, the configuration in which the starter valve is arranged orthogonal to the axial direction of the cylinder involves an extra space in the combustion chamber.

The configuration in which the starter valve is arranged in parallel with the axial direction of the cylinder requires a large thickness to separate the starter valve and the cooling water passage from each other. Thus, the starter valve requires a large space to be disposed in the cylinder head.

In the engine 100 according to the present embodiment, the starter valve 60 is arranged in parallel with the axial direction of the cylinder 11. The sleeve 70 in which the starter valve 60 is fit is inserted in the starter valve insertion hole 28, in such a manner that the outer circumferential surface 70A of the sleeve 70 forms a part of the wall surface of the cooling water passage 26 formed around the sleeve 70. Thus, the starter valve can be disposed in a space saving manner.

A dual-fuel engine requires the cylinder head 20 to be downsized so that the gas device and the diesel device can be disposed in the cylinder head 20. In view of this, the engine 100 according to the present embodiment can be downsized with the starter valve 60 disposed in a space saving manner.

For example, the configuration in which the starter valve 60 is fit in the sleeve 70 requires operations of forming a hole at a position of the sleeve 70 corresponding to the starting air passage 27 and positioning the hole thus formed with at the position corresponding to the starting air passage 27 when the sleeve 70 is inserted in the starter valve insertion hole 28 in an assembly operation.

In the engine 100 according to the present embodiment, the starter valve 60 is inserted in the sleeve 70 in such a manner that the distal end surface 70B of the sleeve 70 forms a part of the wall surface of the starting air passage 27. Thus, the sleeve 70 needs not to be positioned with respect to the starter valve insertion hole 28 in a circumference direction when the starter valve insertion hole 28 is inserted in the sleeve 70. Thus, a higher efficiency of the assembly operation can be achieved.

In the engine 100 according to the present embodiment, the step portion 70C of the sleeve 70 is engaged with the step portion 28C formed on the starter valve insertion hole 28, when the sleeve 70 is inserted in the starter valve insertion hole 28 during the assembly operation. Thus, the sleeve 70 needs not to be positioned with respect to the starter valve insertion hole 28 in the axial direction. Thus, a higher efficiency of the assembly operation can be achieved.

INDUSTRIAL APPLICABILITY

The present invention can be applied to an engine.

REFERENCE SIGNS LIST

10 cylinder block
11 cylinder
12 combustion chamber
20 cylinder head
26 cooling water passage
27 starting air passage (air passage)
28 starter valve insertion hole
40 compressed air starting device
50 cooling device
60 starter valve
70 sleeve
70A outer circumferential surface
70B distal end surface
70C step portion
100 engine

What is claimed is:

1. An engine comprising a cylinder head in which a starter valve with which compressed air is fed to a combustion chamber is provided and a cooling water passage is formed, wherein the starter valve is arranged in parallel with an axial direction of a cylinder while being fit in a sleeve, wherein an outer circumferential surface of the sleeve forms a part of a wall surface of the cooling water passage, wherein the sleeve is fit in a starter valve insertion hole formed in the cylinder head, wherein an air passage is formed in the cylinder head to be orthogonal to an axial direction of the starter valve insertion hole, wherein the air passage communicates with a distal end surface of the sleeve in an inserted direction, and wherein a step portion that engages with a step portion of the starter valve insertion hole is formed on an outer circumference of the sleeve.

2. The engine according to claim 1, wherein the compressed air fed to the combustion chamber is received by the starter valve from the air passage through a supply hole formed in a casing of the starter valve, and wherein the starter valve provides the compressed air to the combustion chamber via the casing.

3. The engine according to claim 1, further comprising a casing positioned between the sleeve and the starter valve, the casing configured to receive the compressed air via a supply hole and to provide the compressed air to combustion chamber, wherein the casing extends past the distal end surface of the sleeve in the axial direction of the starter valve insertion hole, and wherein an outer circumference of the casing defines the supply hole and the supply hole is in fluid communication with the air passage.

4. The engine according to claim 1, wherein a proximal end of the step portion of the sleeve is larger in diameter than a distal end of the step portion of the sleeve, and wherein the proximal end of the step portion is opposite the distal end surface of the sleeve.

5. The engine according to claim 1, wherein the starter valve includes a valve body, a casing, a pilot valve, and a return spring, and further comprising:

a supporting member disposed in the starter valve insertion hole between the starter valve and a lid member, the supporting member defining a supply hole in fluid communication with a control air passage, wherein the pilot valve is positioned within the supporting member; and the lid member disposed in the starter valve insertion hole and coupled to the supporting member.

6. An engine comprising:

a combustion chamber;

a cylinder head defining a starter valve insertion hole, a control fluid passage, a starting fluid passage and a coolant passage;

a sleeve positioned in the starter valve insertion hole; and a starter valve positioned within the sleeve in the starter valve insertion hole and configured to provide starting fluid, received from the starting fluid passage, to the combustion chamber, wherein:

the starter valve is arranged in parallel with an axial direction of a cylinder of the engine, an outer circumferential surface of the sleeve forms a part of a wall surface which defines the coolant passage, the starting fluid passage is orthogonal to the axial direction of the cylinder and to the starter valve insertion hole, and the starting fluid passage is partially defined by a distal end surface of the sleeve opposite a step portion of the sleeve.

7. The engine according to claim 6, wherein the step portion of the sleeve is formed on an outer circumference of the sleeve and engages with a step portion of the starter valve insertion hole.

8. The engine according to claim 6, wherein a proximal end of the step portion of the sleeve is larger in diameter than a distal end of the step portion of the sleeve, and wherein the proximal end of the step portion is opposite the distal end surface of the sleeve.

9. The engine according to claim 6, further comprising a casing positioned between the sleeve and the starter valve, the casing configured to receive the starting fluid via a starting fluid supply hole and to provide the starting fluid to combustion chamber.

10. The engine according to claim 9, wherein the casing extends past the distal end surface of the sleeve in the axial direction of the starter valve insertion hole, and wherein an outer circumference of the casing defines the starting fluid supply hole and the starting fluid supply hole is in fluid communication with the starting fluid passage.

11. The engine according to claim 6, the starter valve comprising a valve body, a casing, a pilot valve, and a return spring.

12. The engine according to claim 11, wherein the starting fluid comprises compressed air, and wherein the control fluid passage is configured to provide control air to the pilot valve of the starter valve to control delivery of the compressed air to the combustion chamber.

13. The engine according to claim 11, further comprising:

a supporting member disposed in the starter valve insertion hole between the starter valve and a lid member, the supporting member defining a control fluid supply hole in fluid communication with a control fluid passage; and the lid member disposed in the starter valve insertion hole and coupled to the supporting member.

14. The engine according to claim 6, wherein the starting fluid passage is positioned between a first potion of the coolant passage and a second portion of the coolant passage with respect to the axial direction of the starter valve insertion hole.

15. The engine according to claim 6, wherein the starting fluid passage is positioned between the coolant passage and a control fluid passage supply hole with respect to the axial direction of the starter valve insertion hole.

16. The engine according to claim 6, wherein the coolant passage is positioned between the step portion of the sleeve and the starting fluid passage with respect to the axial direction of the starter valve insertion hole.

17. The engine according to claim 6, wherein the outer circumferential surface of the sleeve that forms the part of the wall surface of the coolant passage is flat with respect to the axial direction of the starter valve insertion hole.

18. The engine according to claim 6, wherein the engine is a dual-fuel engine.

19. The engine according to claim 6, wherein, during assembly of the engine, the step portion of the sleeve aligns the distal end surface of the sleeve with the starting fluid passage when the sleeve is inserted into starter valve insertion hole.

20. The engine according to claim 19, wherein assembly of the engine does not require lining up holes in the sleeve and the cylinder head to form the starting fluid passage.

* * * * *